US007784562B2

(12) United States Patent
Ikuta

(10) Patent No.: US 7,784,562 B2
(45) Date of Patent: Aug. 31, 2010

(54) IMPACT TOOL

(75) Inventor: Hiroki Ikuta, Anjo (JP)

(73) Assignee: Makita Corporation, Anjo-shi (JP)

( * ) Notice: Subject to any disclaimer, the term of this patent is extended or adjusted under 35 U.S.C. 154(b) by 61 days.

(21) Appl. No.: 12/149,877

(22) Filed: May 9, 2008

(65) Prior Publication Data

US 2008/0283265 A1 Nov. 20, 2008

(30) Foreign Application Priority Data

May 14, 2007 (JP) ..... 2007-128675

(51) Int. Cl.
*B25D 17/24* (2006.01)

(52) U.S. Cl. ..... 173/201; 173/48; 173/109

(58) Field of Classification Search ..... 173/48, 173/109, 201, 212, 122, 133
See application file for complete search history.

(56) References Cited

U.S. PATENT DOCUMENTS

| | | | | |
|---|---|---|---|---|
| 5,678,641 | A | 10/1997 | Manschitz et al. | |
| 5,975,217 | A * | 11/1999 | Frenzel et al. | 173/201 |
| 6,035,945 | A * | 3/2000 | Ichijyou et al. | 173/48 |
| 6,116,352 | A * | 9/2000 | Frauhammer et al. | 173/212 |
| 6,227,309 | B1 * | 5/2001 | Henke et al. | 173/201 |
| 6,431,290 | B1 * | 8/2002 | Muhr et al. | 173/201 |
| 6,644,418 | B2 * | 11/2003 | Haga | 173/48 |
| 6,938,705 | B2 * | 9/2005 | Kikuchi | 173/201 |
| 7,303,026 | B2 * | 12/2007 | Frauhammer et al. | 173/48 |
| 7,383,895 | B2 * | 6/2008 | Aoki | 173/201 |
| 2003/0094292 | A1 | 5/2003 | Haga | |

FOREIGN PATENT DOCUMENTS

| | | |
|---|---|---|
| DE | 26 41 070 A1 | 3/1978 |
| EP | 1 754 575 A2 | 2/2007 |
| JP | A 8-318342 | 12/1996 |

* cited by examiner

*Primary Examiner*—Scott A. Smith
(74) *Attorney, Agent, or Firm*—Oliff & Berridge, PLC

(57) ABSTRACT

It is an object of the invention to provide an effective technique for further enhancing the effect of reducing a reaction force inputted during hammering operation. Representative impact tool comprises a tool body, a hammer actuating member, a cylinder and a compression coil spring. The compression coil spring contacts the hammer actuating member and thereby positions the tool body with respect to the workpiece when the hammer actuating member is pressed against the workpiece and pushed rearward in advance of the hammering operation. In such position, the compression coil spring absorbs a reaction force that is caused by rebound from the workpiece and acts upon the hammer actuating member when the hammer actuating member performs the hammering operation on the workpiece. The cylinder is inserted into the tool body from the front along the axial direction of the hammer actuating member and thereby housed within a predetermined housing part of the tool body. The compression coil spring applies a biasing force to the cylinder in a rearward direction and thereby holds the cylinder in the housing part.

6 Claims, 11 Drawing Sheets

IMPACT TOOL

BACKGROUND OF THE INVENTION

1. Field of the Invention

The present invention relates to an impact tool for performing a linear hammering operation on a workpiece, and more particularly to a technique for cushioning a reaction force received from the workpiece during hammering operation.

2. Description of the Related Art

Japanese non-examined laid-open Patent Publication No. 8-318342 discloses a hammer wherein a cushioning member defined by a rubber ring is disposed between the component part on the tool body side and the impact bolt in order to reduce the reaction force caused by rebound of the hammer bit by the cushioning action of the cushioning member.

SUMMARY OF THE INVENTION

It is an object of the invention to provide an effective technique for further enhancing the effect of reducing a reaction force inputted during hammering operation.

Above-described object is achieved by the claimed invention. Representative impact tool performs a predetermined hammering operation on a workpiece by a striking movement of a hammer actuating member in its axial direction. The impact tool includes a tool body, a cylinder housed within the tool body and a compression coil spring. The "predetermined hammering operation" may include not only a hammering operation but a hammer drill operation. When the hammer actuating member is pressed against the workpiece and pushed to the side of the tool body in advance of the hammering operation, the compression coil spring contacts the hammer actuating member and thereby positions the tool body with respect to the workpiece. Further, in this state, the compression coil spring absorbs a reaction force which is caused by rebound from the workpiece and which acts on the hammer actuating member when the hammer actuating member performs a hammering operation on the workpiece.

The reaction force that acts on the hammer actuating member during the hammering operation can be absorbed by the compression coil spring which is pushed rearward by the hammer actuating member and elastically deforms. As a result, vibration of the impact tool can be lowered. The compression coil spring is configured to normally have excess pressure larger than a user's force of pressing the hammer actuating member against the workpiece. According to the invention, an effective technique for enhancing the effect of reducing a reaction force inputted during hammering operation is provided.

The cylinder may preferably be inserted into the tool body from the front along the axial direction of the hammer actuating member and thereby housed within a predetermined housing part of the tool body. Further, the compression coil spring may apply a biasing force to the cylinder in a rearward direction and thereby holds the cylinder in the housing part. Preferably, the compression coil spring may be disposed outside the cylinder in order to prevent increase in the length of the impact tool in the axial direction. According to this construction, the cylinder can be held in the predetermined housing part within the tool body by utilizing the biasing force of the reaction force absorbing compression coil spring, so that the cylinder can be prevented from becoming dislodged from the tool body. Therefore, the need for a special locking means for locking the cylinder to the tool body is eliminated. Thus, the cylinder can be easily mounted or dismounted to or from the tool body, and the structure can be simplified.

Further, the compression coil spring may preferably be disposed outside the cylinder, and an axial rear end of the compression coil spring may be locked such that it is prevented from moving rearward with respect to the cylinder, while an axial front end of the compression coil spring is locked such that it is allowed to move rearward and prevented from moving frontward with respect to the cylinder. With this construction, the cylinder and the compression coil spring are integrated into one component. Therefore, the cylinder and the compression coil spring can be mounted to the tool body as one complete component. Thus, the ease of mounting or repair can be increased.

The impact tool may preferably include a driving element that linearly moves in the axial direction of the hammer actuating member within the cylinder, a striking element that linearly moves in the axial direction of the hammer actuating member within the cylinder, and an air chamber defined between the driving element and the striking element within the cylinder. The striking element may be caused to linearly move via pressure fluctuations of the air chamber as a result of the linear movement of the driving element and strikes the hammer actuating member. In this manner, a predetermined hammering operation is performed on the workpiece. The impact tool may further include a communication part that is formed in the cylinder and provide communication between the air chamber and the outside, and a movable member that is disposed outside the cylinder and movable between an open position for opening the communication part and a closed position for closing the communication part. The movable member serves as a reaction force transmitting member for transmitting the reaction force of rebound which acts upon the hammer actuating member, to the compression coil spring. The "movable member" in this invention typically represents a cylindrical member that is slidably fitted onto the cylinder. The "cylindrical member" here suitably includes not only a member having a cylindrical shape in its entirety, but also a member having a cylindrical shape in part.

As a result, the movable member that controls opening and closing of the communication part for preventing idle driving also serves as a reaction force transmitting member for transmitting the reaction force caused by rebound of the hammer actuating member to the reaction force absorbing compression coil spring. Therefore, the number of parts can be reduced and the structure can be simplified. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved impact tools and method for using such impact tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment of the Invention

Figure 1:
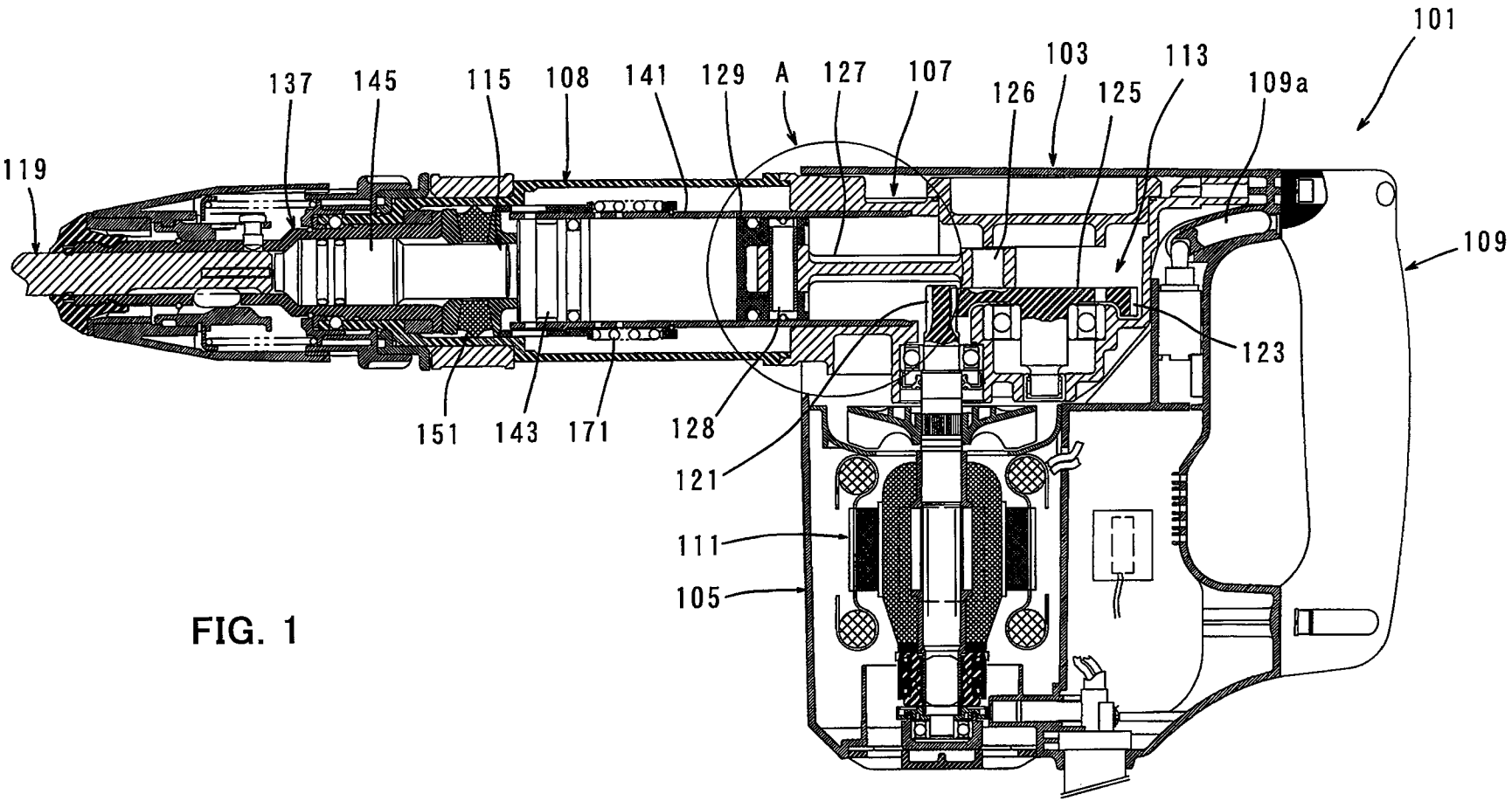
FIG. 1 is a sectional side view schematically showing an entire electric hammer according to a first embodiment of this invention.
Figure 2:
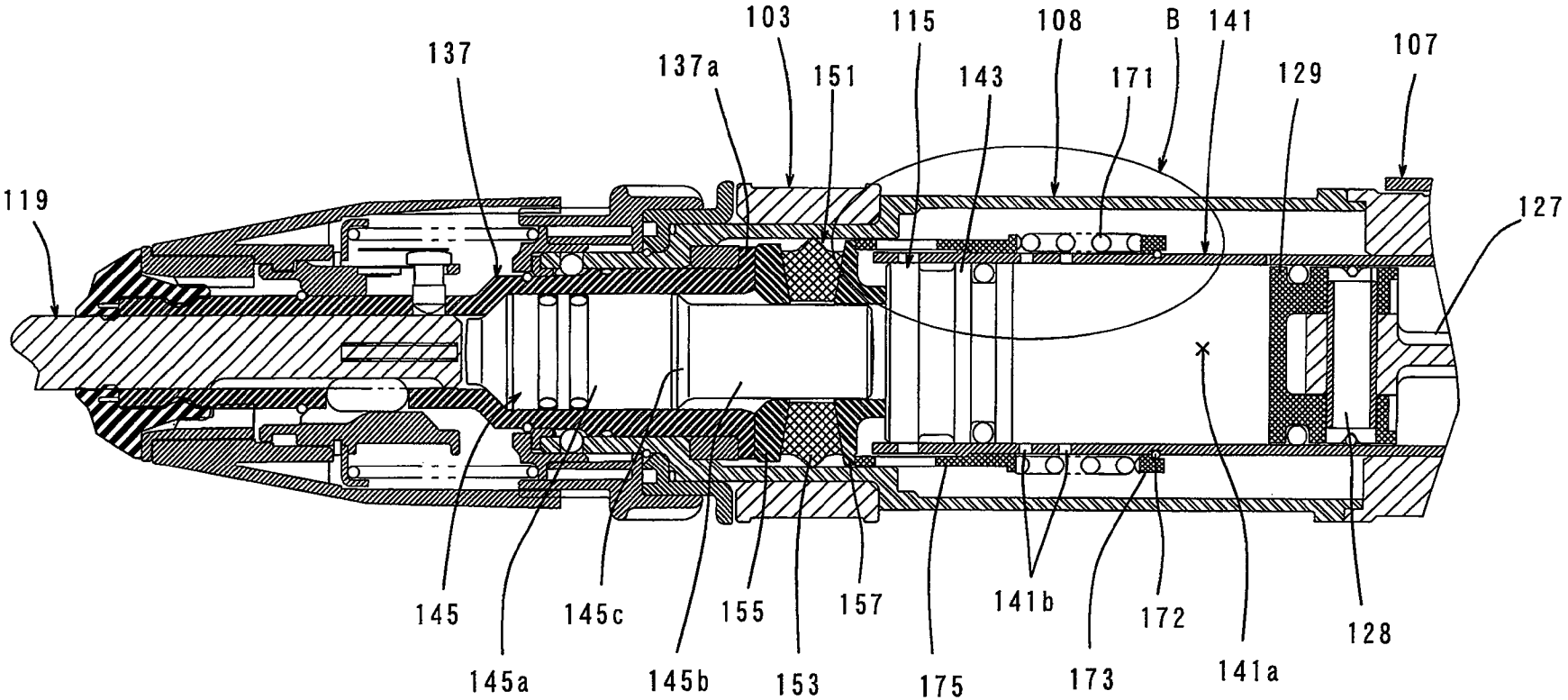
FIG. 2 is an enlarged sectional view showing an essential part of the hammer, under unloaded conditions in which a hammer bit is not pressed against a workpiece.
Figure 3:
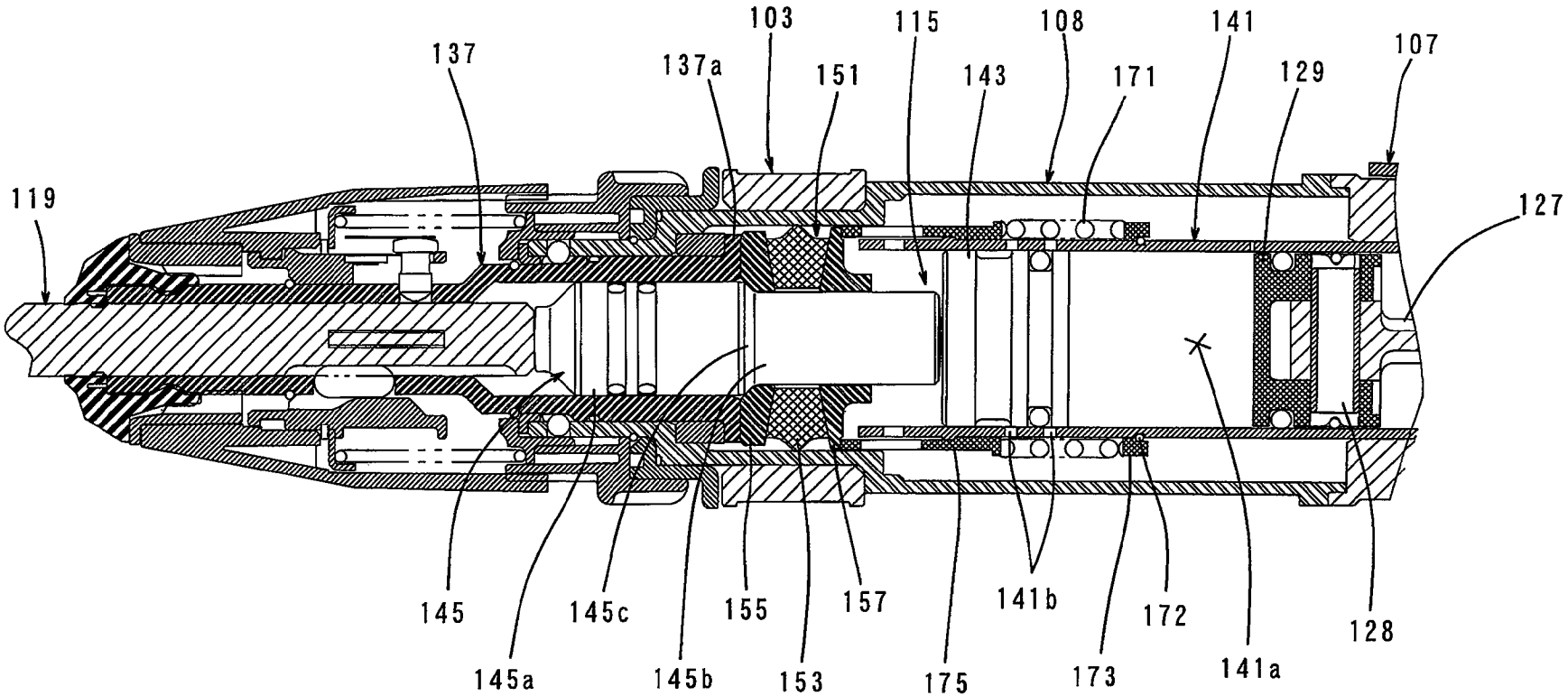
FIG. 3 is a sectional plan view of the hammer, under loaded conditions in which the hammer bit is pressed against a workpiece.
Figure 4:
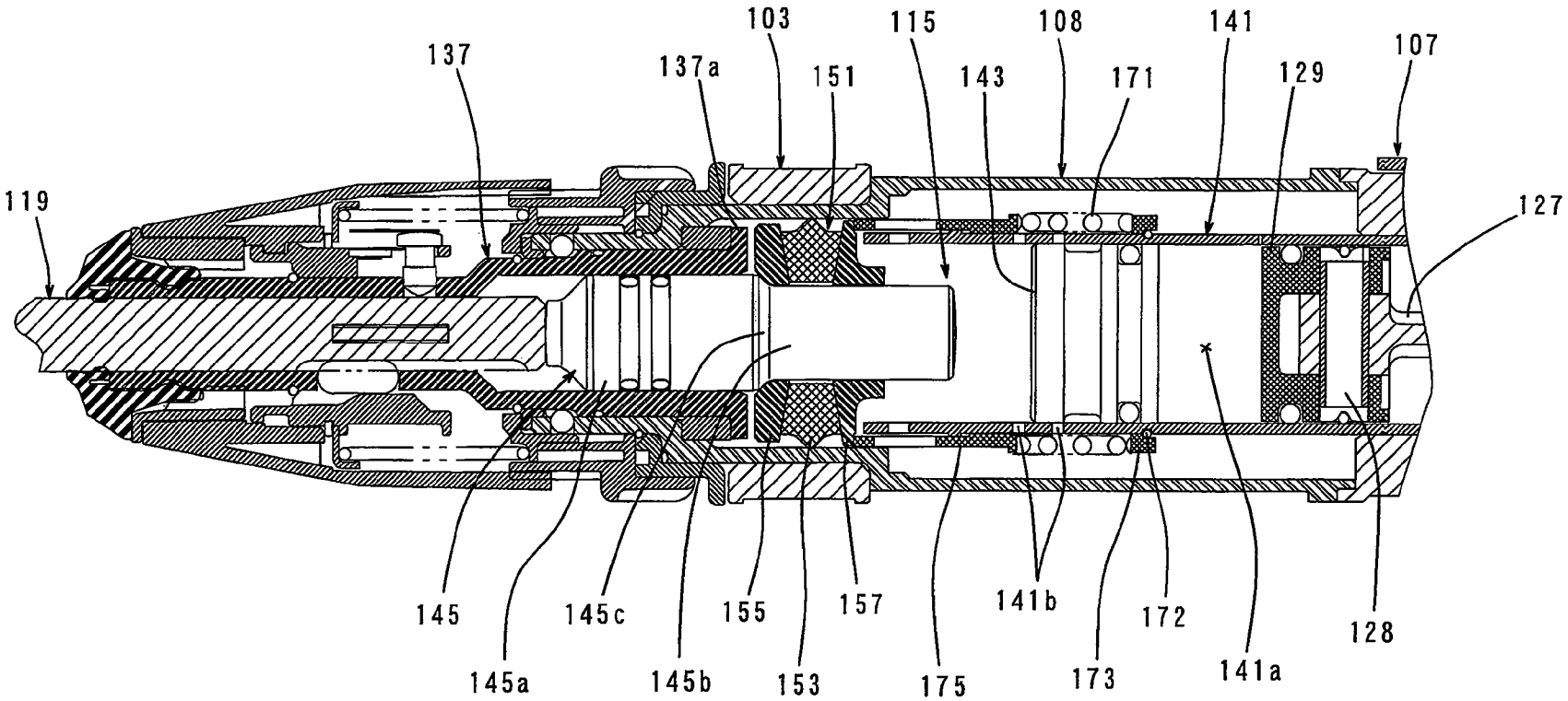
FIG. 4 is a sectional plan view of the hammer, in the state of absorbing a reaction force caused by rebound of the hammer bit.
Figure 5:
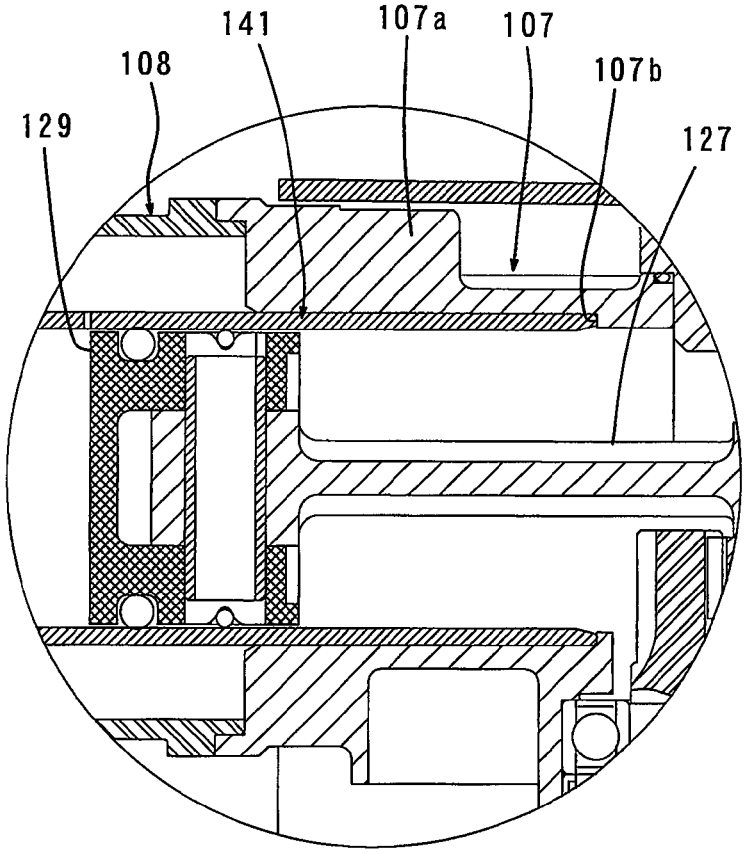
FIG. 5 is an enlarged view of part A in FIG. 1.
Figure 6:
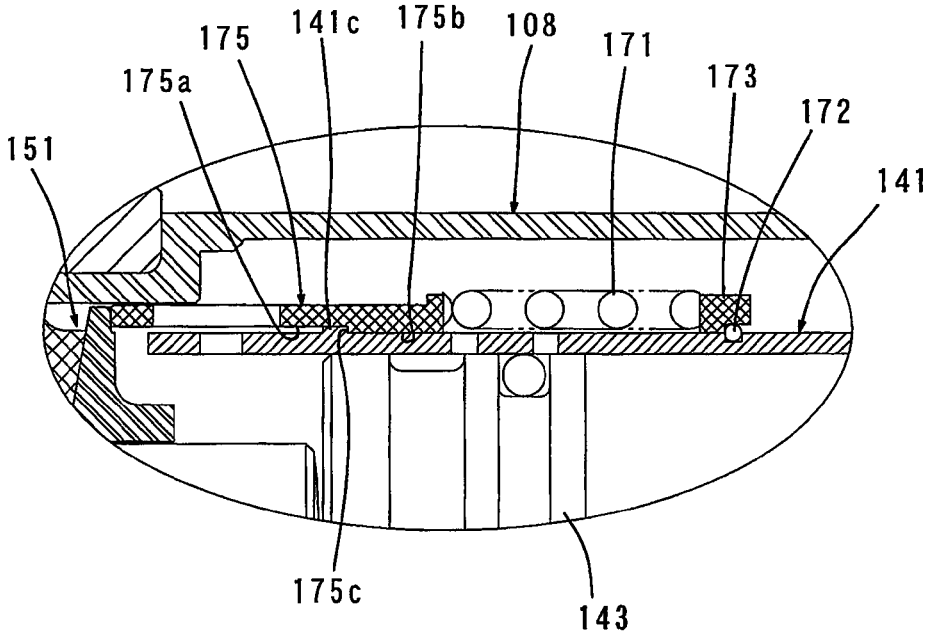
FIG. 6 is an enlarged view of part B in FIG. 2.

A first embodiment of the present invention is now described with reference to FIGS. 1 to 6. FIG. 1 is a sectional side view showing an entire electric hammer 101 as a representative embodiment of the impact tool according to the present invention. FIGS. 2 to 4 are enlarged sectional views each showing an essential part of the hammer, under unloaded conditions in which a hammer bit is not pressed against the workpiece, under loaded conditions in which the hammer bit is pressed against the workpiece, and in a reaction force absorbing state, respectively. FIG. 5 is an enlarged view of part A in FIG. 1, and FIG. 6 is an enlarged view of part B in FIG. 2.

As shown in FIG. 1, the electric hammer 101 of this embodiment includes a body 103, a hammer bit 119 detachably coupled to the tip end region (on the left side as viewed in FIG. 1) of the body 103 via a tool holder 137, and a handgrip 109 that is connected to the body 103 on the side opposite the hammer bit 119 and designed to be held by a user. The body 103 is a feature that corresponds to the "tool body" according to the present invention. The hammer bit 119 is held by the tool holder 137 such that it is allowed to reciprocate with respect to the tool holder 137 in its axial direction and prevented from rotating with respect to the tool holder 137 in its circumferential direction. In the present embodiment, for the sake of convenience of explanation, the side of the hammer bit 119 is taken as the front side and the side of the handgrip 109 as the rear side.

The body 103 includes a motor housing 105 that houses a driving motor 111, and a gear housing 107 that houses a motion converting mechanism 113 and a striking mechanism 115. The motion converting mechanism 113 is adapted to appropriately convert the rotating output of the driving motor 111 to linear motion and then to transmit it to the striking mechanism 115. As a result, an impact force is generated in the axial direction of the hammer bit 119 via the striking mechanism 115. Further, a slide switch 109*a* is provided on the handgrip 109 and can be slid by the user to drive the driving motor 111.

The motion converting mechanism 113 includes a driving gear 121 that is rotated in a horizontal plane by the driving motor 111, a crank plate 125 having a driven gear 123 that engages with the driving gear 121, a crank arm 127 that is loosely connected at its one end to the crank plate 125 via an eccentric shaft 126 in a position displaced a predetermined distance from the center of rotation of the crank plate 125, and a driving element in the form of a piston 129 mounted to the other end of the crank arm 127 via a connecting shaft 128. The crank plate 125, the crank arm 127 and the piston 129 form a crank mechanism.

As shown in FIGS. 2 to 4, the striking mechanism 115 includes a striking element in the form of a striker 143 that is slidably disposed within the bore of the cylinder 141, and an intermediate element in the form of an impact bolt 145 that is slidably disposed within the tool holder 137 and transmits the kinetic energy of the striker 143 to the hammer bit 119. An air chamber 141*a* is defined between the piston 129 and the striker 143 within the cylinder 141. The striker 143 is driven via the action of an air spring of the air chamber 141*a* of the cylinder 141 which is caused by sliding movement of the piston 129. The striker 143 then collides with (strikes) the intermediate element in the form of the impact bolt 145 that is slidably disposed within the tool holder 137 and transmits the striking force to the hammer bit 119 via the impact bolt 145. The impact bolt 145 and the hammer bit 119 are features that correspond to the "hammer actuating member" according to this invention.

The cylinder 141 is inserted from the front into the bore of a cylindrical cylinder holding portion 107*a* formed in the front region of the gear housing 107, and the inserted end of the cylinder 141 contacts an end surface 107*b* which is formed in the cylinder holding portion 107*a* in a direction transverse to the direction of insertion of the cylinder 141. By this contact, the rear end position of the cylinder 141 is defined. The cylinder holding portion 107*a* is a feature that corresponds to the "predetermined housing part" according to this invention. The entire region of the cylinder 141 except the region received by the cylinder holding portion 107*a* is housed within a cylindrical member (barrel) 108 which is formed as a separate member from the gear housing 107. The cylindrical member 108 and the gear housing 107 are however connected fixedly to each other by screws (not shown) and virtually formed as one component.

The air chamber 141*a* serves to drive the striker 143 via the action of the air spring and communicates with the outside via air vents 141*b* that are formed in the cylinder 141 in order to prevent idle driving. Under unloaded conditions in which the hammer bit 119 is not pressed against the workpiece, or in the state in which the impact bolt 145 is not pushed rearward (rightward as viewed in FIG. 2), the striker 143 is allowed to move to a forward position for opening the air vents 141*b* (see FIG. 2). On the other hand, under loaded conditions in which the hammer bit 119 is pressed against the workpiece by the user's pressing force applied forward to the tool body 103, the striker 143 is pushed by the retracting impact bolt 145 and moved to a rearward position for closing the air vents 141*b* (see FIG. 3).

Thus, the striker 143 controls opening and closing of the air vents 141*b* of the air chamber 141*a*. Opening of the air vents 141*b* disables the action of the air spring, while closing of the air vents 141*b* enables the action of the air spring. Specifically, the air vents 141*b* and the striker 143 form an idle driving prevention mechanism of the type that opens the air chamber to prevent the hammer bit 119 from driving under unloaded conditions (idle driving).

In the hammer 101, when the hammer bit 119 is pressed against the workpiece by the user's pressing force applied forward to the body 103, the impact bolt 145 is pushed rearward (toward the piston 129) together with the hammer bit 119 and comes into contact with a body-side member. As a result, the body 103 is positioned with respect to the workpiece. In this embodiment, such positioning is effected by a compression coil spring 171 designed for absorbing a reaction force, via a positioning member 151 and a reaction force transmitting member in the form of a spring receiving member 175.

The positioning member 151 is a unit part including a rubber ring 153, a front-side hard metal washer 155 joined to the axial front side of the rubber ring 153, and a rear-side hard metal washer 157 joined to the axial rear side of the rubber ring 153. The positioning member 151 is loosely fitted onto a small-diameter portion 145*b* of the impact bolt 145. The impact bolt 145 has a stepped, cylindrical form having a large-diameter portion 145*a* that is slidably fitted in the cylindrical portion of the tool holder 137 and a small-diameter portion 145*b* formed on the rear side of the large-diameter portion 145*a*. The impact bolt 145 has a tapered portion 145*c* formed between the outside wall surface of the large-diameter portion 145*a* and the outside wall surface of the small-diameter portion 145*b*. Further, the positioning member 151 is disposed between the outside wall surface of the small-diameter portion 145*b* and the inside wall surface of the cylindrical member 108.

Under loaded conditions in which the hammer bit 119 is pressed against the workpiece by the user, when the impact bolt 145 is retracted together with the hammer bit 119, the tapered portion 145*c* of the impact bolt 145 contacts the positioning member 151 in a predetermined retracted position. The rear metal washer 157 of the positioning member 151 is held in contact with the spring receiving member 175 which receives the biasing force of the compression coil spring 171. The compression coil spring 171 elastically receives the user's pressing force of pressing the hammer bit 119 against the workpiece, so that the body 103 is positioned with respect to the workpiece. Therefore, the compression coil spring 171 is configured to normally have excess pressure larger than a user's force of pressing the hammer bit 119 against the workpiece. This state is shown in FIG. 3.

As shown in FIG. 6 in enlarged view, the compression coil spring 171 is disposed outside the cylinder 141 and elastically placed between the front surface of a spring receiving ring 173 which is fastened to the cylinder 141 via a retaining ring 172 and the rear surface of the spring receiving member 175. The spring receiving member 175 is a cylindrical component disposed between the positioning member 151 and the compression coil spring 171. The spring receiving member 175 is fitted on the cylinder 141 such that it can slide in the axial direction of the hammer bit. The front end of the spring receiving member 175 is held in contact with the rear surface of the rear metal washer 157 of the positioning member 151. The positioning member 151 is held in contact with a rear end 137*a* of the tool holder 137. Therefore, the tool holder 137 and the cylinder 141 receive the biasing force of the compression coil spring 171. Thus, the biasing force of the compression coil spring 171 normally acts upon the cylinder 141 in such a manner as to press the cylinder 141 against the end surface 107*b* of the cylinder holding portion 107*a* (see FIG. 5). In this manner, the cylinder 141 can be prevented from becoming dislodged from the cylinder holding portion 107*a*.

Further, as shown in FIG. 6, the spring receiving member 175 has a stepped bore having a large inside-diameter portion 175*a* and a small inside-diameter portion 175*b*. A stepped engagement surface 175*c* is formed between the large inside-diameter portion 175*a* and the small inside-diameter portion 175*b* and contacts or is allowed to contact a flange 141*c* of the cylinder 141 from the rear. The flange 141*c* is formed on the outer periphery of the cylinder 141 and protrudes radially outward therefrom. Specifically, the flange 141*c* forms a stopper that defines a maximum advanced position of the spring receiving member 175 with respect to the cylinder 141. Thus, the compression coil spring 171 is installed such that its front end is allowed to move rearward (in the direction of compression) with respect to the cylinder 141.

Operation of the hammer 101 constructed as described above is now explained. When the driving motor 111 (shown in FIG. 1) is driven, the rotating output of the driving motor 111 causes the driving gear 121 to rotate in the horizontal plane. When the driving gear 121 rotates, the crank plate 125 revolves in the horizontal plane via the driven gear 123 that engages with the driving gear 121. Then, the piston 129 is caused to linearly slide within the cylinder 141 via the crank arm 127. At this time, under unloaded conditions in which the hammer bit 119 is not pressed against the workpiece, as shown in FIG. 2, the impact bolt 145 is placed in the forward position. As a result, the striker 143 is moved or allowed to move to its forward position for opening the air vents 141*b*. Therefore, when the piston 129 moves forward or rearward, air is let out of or into the air chamber 141*a* through the air vents 141*b*. Thus, the air chamber 141*a* is prevented from performing the action of the compression spring. This means that the hammer bit 119 is prevented from idle driving.

On the other hand, under loaded conditions in which the hammer bit 119 is pressed against the workpiece, as shown in FIG. 3, the impact bolt 145 is pushed rearward together with the hammer bit 119 and in turn pushes the striker 143 rearward, so that the striker 143 closes the air vents 141*b*. Thus, the striker 143 reciprocates within the cylinder 141 and collides with (strikes) the impact bolt 145 by the action of the air spring function within the cylinder 141 as a result of the sliding movement of the piston 129. The kinetic energy of the striker 143 which is caused by the collision with the impact bolt 145 is transmitted to the hammer bit 119. Thus, the hammer bit 119 performs a striking movement in its axial direction, and the hammering operation is performed on the workpiece.

As described above, hammering operation is performed under the loaded conditions in which the hammer bit 119 is pressed against the workpiece. When the hammer bit 119 is pressed against the workpiece, the hammer bit 119 is pushed rearward and in turn retracts the impact bolt 145. When the impact bolt 145 is retracted, the tapered portion 145*c* of the impact bolt 145 contacts the front metal washer 155 of the positioning member 151. The rear metal washer 157 of the positioning member 151 is held in contact with the spring receiving member 175 which receives the biasing force of the compression coil spring 171. Therefore, the compression coil spring 171 elastically receives the user's pressing force of pressing the hammer bit 119 against the workpiece. This state is shown in FIG. 3. Thus, the body 103 is positioned with respect to the workpiece, and in this state, a hammering operation is performed.

When the hammer bit 119 performs a striking movement upon the workpiece and is caused to rebound by the reaction force from the workpiece, a force caused by this rebound or reaction force moves the hammer bit 119, the impact bolt 145, the positioning member 151 and the spring receiving member 175 rearward and elastically deforms (compresses) the compression coil spring 171. Specifically, the reaction force caused by rebound of the hammer bit 119 is effectively absorbed by elastic deformation of the compression coil spring 171, so that transmission of the reaction force to the body 103 is reduced. This state is shown in FIG. 4. At this time, the rear metal washer 157 of the positioning member 151 faces the front end surface of the cylinder 141 with a predetermined clearance therebetween and can come into contact with it, so that the maximum retracted position of the positioning member 151 is defined. Therefore, the reaction force absorbing action of the compression coil spring 171 is effected within the range of the above-mentioned clearance.

As described above, according to this embodiment, the cylinder 141 is normally pressed against the end surface 107*b* of the cylinder holding portion 107*a* by the biasing force of the compression coil spring 171 which acts in the rearward direction (see FIG. 5). Thus, the cylinder 141 can be prevented from becoming dislodged from the cylinder holding portion 107*a*. In a construction in which the biasing force of the compression coil spring 171 does not act upon the cylinder 141, a locking means must be provided in order to lock the cylinder 141 to the cylinder holding portion 107*a*. For example, an elastic ring, such as an O-ring, may be disposed between the cylinder 141 and the cylinder holding portion 107*a* such that elastic deformation of the elastic ring by an amount corresponding to the interference of the elastic ring is utilized to prevent the cylinder 141 from becoming dislodged from the cylinder holding portion 107*a*. According to this embodiment, however, the need for such a locking means is eliminated, so that the structure can be simplified. Further, due to elimination of the need for the locking means, the cylinder can be easily mounted or dismounted to or from the tool body.

Further, according to this embodiment, the compression coil spring 171 is disposed outside the cylinder 141. One end (rear end) of the compression coil spring 171 is received by the spring receiving ring 173 which is prevented from moving rearward by a retaining ring 172 fastened to the cylinder 141, while the other end (front end) is received by the spring receiving member 175 which is prevented from moving forward by the flange 141*c* of the cylinder 141. Thus, the cylinder 141 and the compression coil spring 171 are integrated into one component. Therefore, the cylinder 141 and the compression coil spring 171 can be mounted or dismounted to or from the cylinder holding portion 107*a* of the gear housing 107 as one complete component. Thus, the ease of mounting or repair can be increased. In this connection, the cylindrical member 108 is mounted to the gear housing 107 after the cylinder 141 is mounted to the gear housing 107.

Further, in this embodiment, positioning of the body 103 is performed by the compression coil spring 171. With this construction, by strongly pressing the hammer bit 119 against the workpiece, the compression coil spring 171 can be deformed so that the impact bolt 145 is allowed to move farther rearward. Specifically, according to this invention, when the hammer bit 119 is strongly pressed against the workpiece, the amount of movement of the striker 143 toward the piston 129 can be increased, so that suction of the striker 143 is improved. The suction here represents a phenomenon in which, when the air chamber 141*a* expands by the retracting movement of the piston 129, air within the air chamber 141*a* is cooled and the pressure of the air chamber 141*a* is reduced, which causes the striker 143 to move rearward.

Preferably, an O-ring is disposed between the cylinder 141 and the cylinder holding portion 107*a* in order to prevent rattling therebetween.

Second Embodiment of the Invention

Figure 7:
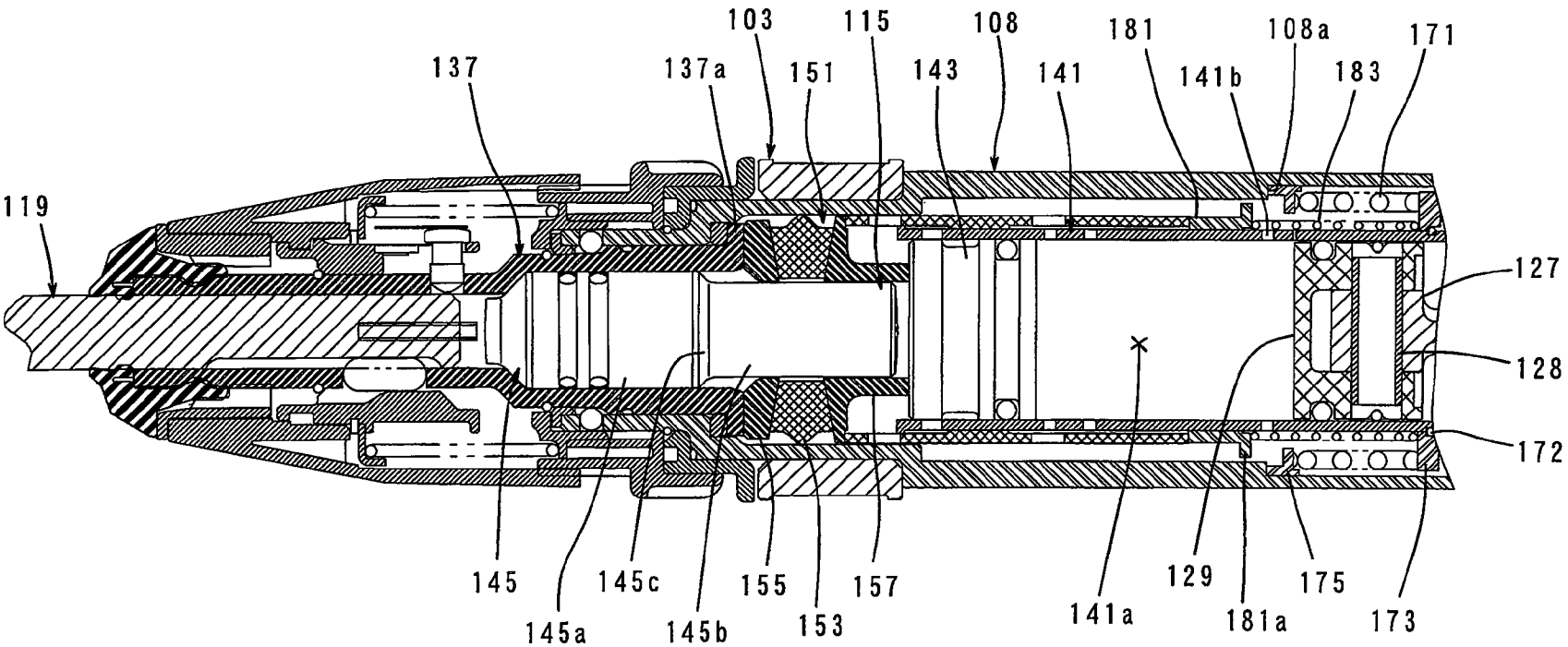
FIG. 7 is an enlarged sectional view showing an essential part of an electric hammer according to a second embodiment of this invention, under unloaded conditions in which a hammer bit is not pressed against a workpiece.
Figure 8:
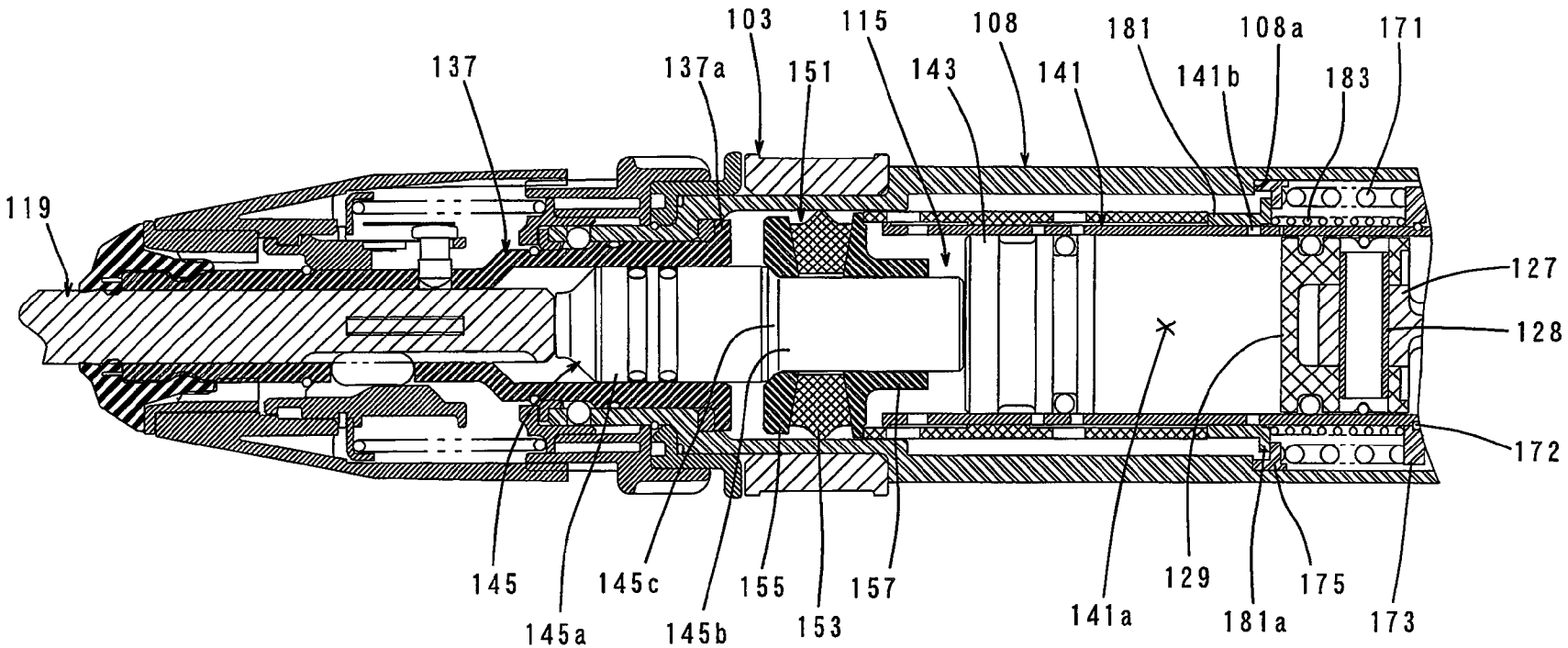
FIG. 8 is an enlarged sectional view showing the essential part of the electric hammer, under loaded conditions in which the hammer bit is pressed against a workpiece.
Figure 9:
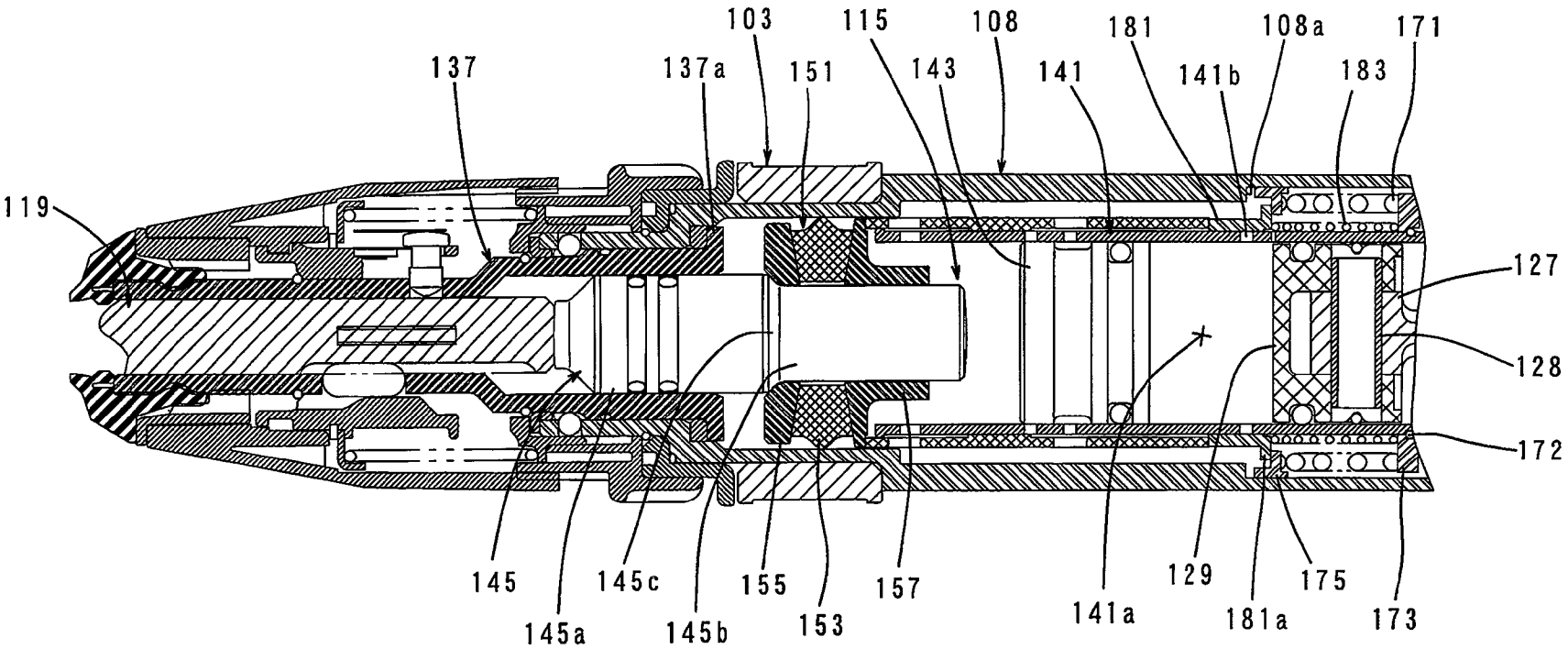
FIG. 9 is a sectional plan view of the hammer, in the state of absorbing a reaction force caused by rebound of the hammer bit.

A second embodiment of the present invention is now described with reference to FIGS. 7 to 9. FIG. 7 shows the unloaded state in which the hammer bit is not pressed against the workpiece, FIG. 8 shows the loaded state in which the hammer bit is pressed against the workpiece, and FIG. 9 shows the reaction force absorbing state. In this embodiment, an idle driving prevention mechanism of the type that opens the air chamber to prevent the hammer bit 119 from performing a striking movement under unloaded conditions includes a slide sleeve 181. The slide sleeve 181 is disposed outside the cylinder 141 and serves to open and close the air vents 141*b*. In the other points, it has the same construction as the first embodiment. Components or elements in this embodiment which are substantially identical to those in the first embodiment are given like numerals as in the first embodiment and will not be described.

As shown in FIGS. 7 to 9, the idle driving prevention mechanism include the air vents 141*b*, the cylindrical sleeve 181 that opens and closes the air vents 141*b*, a pressure spring 183 that biases the slide sleeve 181 toward the open position. The slide sleeve 181 is a feature that corresponds to the "movable member" according to this invention. The slide sleeve 181 is disposed in the outer peripheral region of the cylinder 141 and can move in the axial direction of the hammer bit between an open position for opening the air vents 141*b* and a closed position for closing the air vents 141*b*. The biasing member in the form of the pressure spring 183 is a compression coil spring. The pressure spring 183 is disposed in the rear of the outer peripheral region of the cylinder 141 and biases the slide sleeve 181 forward in order to hold the slide sleeve 181 in the open position. The pressure spring 183 is elastically disposed between the axial rear end surface of the slide sleeve 181 and the spring receiving ring 173 and biases the slide sleeve 181 forward. The spring receiving ring 173 is prevented from moving rearward by the retaining ring 172 fastened to the cylinder 141. Therefore, under unloaded conditions in which the hammer bit 119 is not pressed against the workpiece, the slide sleeve 181 is held in the open position to open the air vents 141*b* and disables the action of the air spring (see FIG. 7).

Further, under unloaded conditions, the slide sleeve 181 is pushed forward by the pressure spring 183, and the front end surface of the slide sleeve 181 pushes the front metal washer 155 of the positioning member 151 forward. The pushed front metal washer 155 contacts the rear end 137*a* of the tool holder 137 and is held in this position. At this time, the rear metal washer 157 of the positioning member 151 is separated from the front end of the cylinder 141.

Further, in this embodiment, the slide sleeve 181 consists of two sleeve halves in the axial direction. The sleeve halves move as one, and therefore, virtually, they may be integrally formed as one component.

On the other hand, under loaded conditions (shown in FIG. 8) in which the hammer bit 119 is pressed against the workpiece and the impact bolt 145 is pushed rearward together with the hammer bit 119, the slide sleeve 181 is moved to a rearward closed position via the positioning member 151 and closes the air vents 141*b*. Closing of the air vents 141*b* enables the action of the air spring. At this time, a rear end 181*a* of the slide sleeve 181 contacts the spring receiving member 175 of the reaction force absorbing compression coil spring 171, which allows the compression coil spring 171 to elastically deform to thereby absorb the reaction force. Specifically, the slide sleeve 181 serves as a reaction force transmitting member for transmitting the reaction force of rebound to the reaction force absorbing compression coil spring 171.

The reaction force absorbing compression coil spring 171 is arranged radially outward of the pressure spring 183 in parallel and in the same position as the pressure spring 183 on the axis of the hammer bit 119. The compression coil spring 171 is disposed between the spring receiving ring 173 and the spring receiving member 175. The spring receiving ring 173 is prevented from moving rearward by the retaining ring 172 fastened to the cylinder 141 as mentioned above, and the spring receiving member 175 is prevented from moving forward by a stepped surface 108*a* which is formed in the cylindrical member 108 in a direction transverse to the longitudinal direction of the cylindrical member 108. Thus, the biasing force of the compression coil spring 171 acts upon the cylinder 141 in the direction of insertion of the cylinder, or in such a manner as to press the cylinder 141 rearward. As a result, like in the above-described first embodiment, the cylinder 141 is pressed against the end surface 107*b* of the cylinder holding portion 107*a* (see FIG. 5) and held prevented from becoming dislodged therefrom.

According to this embodiment thus constructed, when the driving motor 111 is driven and the piston 129 is caused to linearly slide within the cylinder 141, under unloaded conditions in which the hammer bit 119 is not pressed against the workpiece, as shown in FIG. 7, the slide sleeve 181 is biased forward by the pressure spring 183 and placed in the open position for opening the air vents 141*b*. Therefore, when the piston 129 is moved forward or rearward, air is let out of or into the air chamber 141*a* through the air vents 141*b*. Thus, the air chamber 141*a* is prevented from performing the action of the compression spring. This means that the hammer bit 119 is prevented from idle driving.

On the other hand, under loaded conditions in which the hammer bit 119 is pressed against the workpiece, as shown in FIG. 8, the impact bolt 145 is retracted together with the hammer bit 119 and in turn pushes the positioning member 151. Then the slide sleeve 181 is moved rearward via the positioning member 151 and closes the air vents 141*b*. Thus, the striker 143 reciprocates within the cylinder 141 and collides with (strikes) the impact bolt 145 by the action of the air spring function within the cylinder 141 as a result of the sliding movement of the piston 129. The kinetic energy of the striker 143 which is caused by the collision with the impact bolt 145 is transmitted to the hammer bit 119. Thus, the hammer bit 119 performs a striking movement in its axial direction, and the hammering operation is performed on the workpiece.

Further, when the hammer bit 119 is pressed against the workpiece, the slide sleeve 181 is moved rearward and contacts the spring receiving member 175 of the reaction force absorbing compression coil spring 171. Therefore, the force of pressing the hammer bit 119 against the workpiece is elastically received by the compression coil spring 171 (see FIG. 8). As a result, the body 103 is positioned with respect to the workpiece, and in this state, the hammering operation is performed. Therefore, the compression coil spring 171 is configured to normally have excess pressure larger than a user's force of pressing the hammer bit 119 against the workpiece.

When the hammer bit 119 performs a striking movement upon the workpiece and is caused to rebound by the reaction force from the workpiece, a reaction force caused by this rebound moves the hammer bit 119, the positioning member 151, the slide sleeve 181 and the spring receiving member 175 rearward and elastically deforms the compression coil spring 171. Specifically, the reaction force caused by rebound of the hammer bit 119 is absorbed by elastic deformation of the compression coil spring 171, so that transmission of the reaction force to the body 103 is reduced. This state is shown in FIG. 9. At this time, the rear metal washer 157 of the positioning member 151 faces the front end surface of the cylinder 141 with a predetermined clearance therebetween and can come into contact with it, so that the maximum retracted position of the positioning member 151 is defined. Therefore, the reaction force absorbing action of the compression coil spring 171 is effected within the range of the above-mentioned clearance.

In this embodiment, the cylinder 141 is normally pressed against the end surface 107*b* (see FIG. 5) of the cylinder holding portion 107*a* by the biasing force of the compression coil spring 171 which acts in the rearward direction. Thus, the cylinder 141 can be prevented from becoming dislodged from the cylinder holding portion 107*a*. Therefore, like in the above-described first embodiment, the need for a locking means for locking the cylinder 141 to the cylinder holding portion 107*a* is eliminated, so that the structure can be simplified. Further, due to elimination of the need for the locking means, the cylinder can be easily mounted or dismounted to or from the tool body.

Particularly, in this embodiment, the slide sleeve 181 that controls opening and closing of the air vents 141*b* for preventing idle driving also serves as a reaction force transmitting member for transmitting the reaction force caused by rebound of the hammer bit 119 to the reaction force absorbing compression coil spring 171. Therefore, compared with the case in which a reaction force transmitting member is additionally provided, the number of parts can be reduced and the structure can be simplified. Further, in this embodiment, the pressure spring 183 for preventing idle driving and the compression coil spring 171 for absorbing the reaction force are arranged in parallel in the radial direction and in the same position on the axis of the hammer bit 119. Therefore, the compression coil spring 171 can be rationally arranged without changing the length of the impact tool in the longitudinal direction.

Third Embodiment of the Invention

Figure 10:
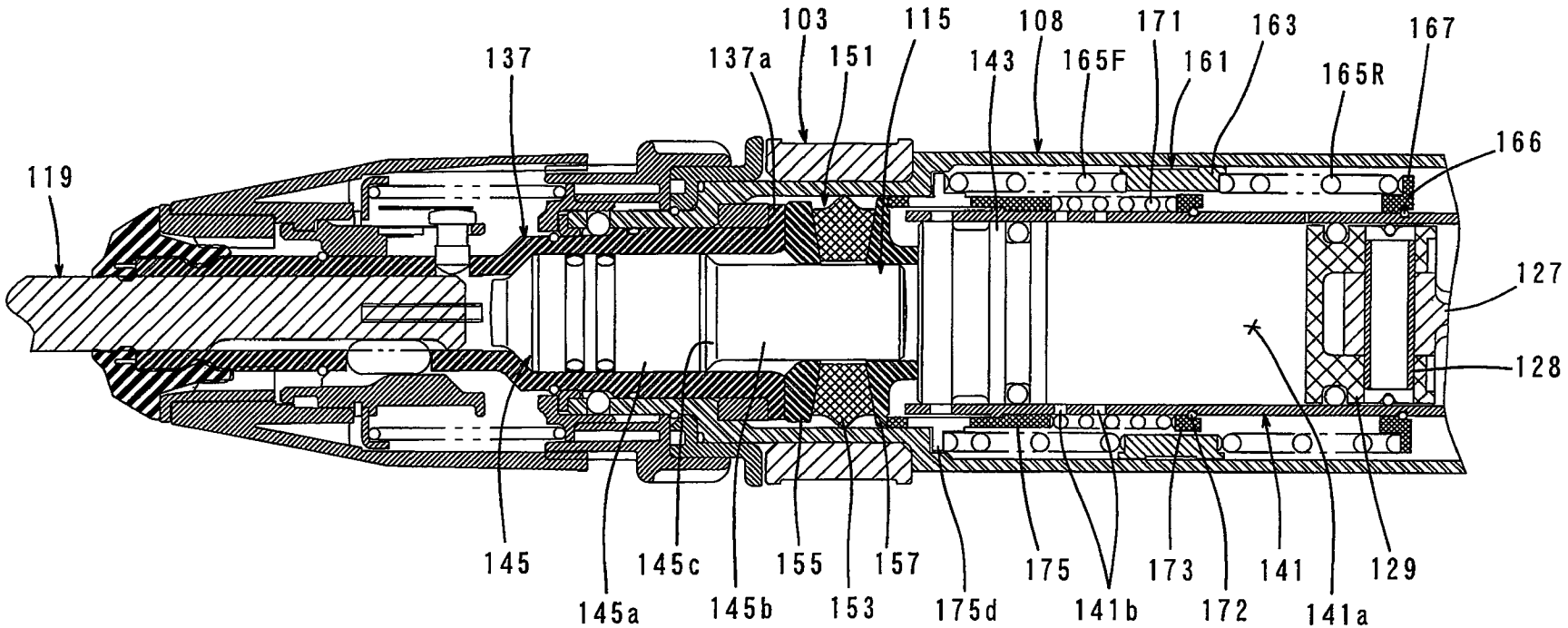
FIG. 10 is an enlarged sectional view showing an essential part of an electric hammer according to a third embodiment of this invention, under unloaded conditions in which a hammer bit is not pressed against a workpiece.
Figure 11:
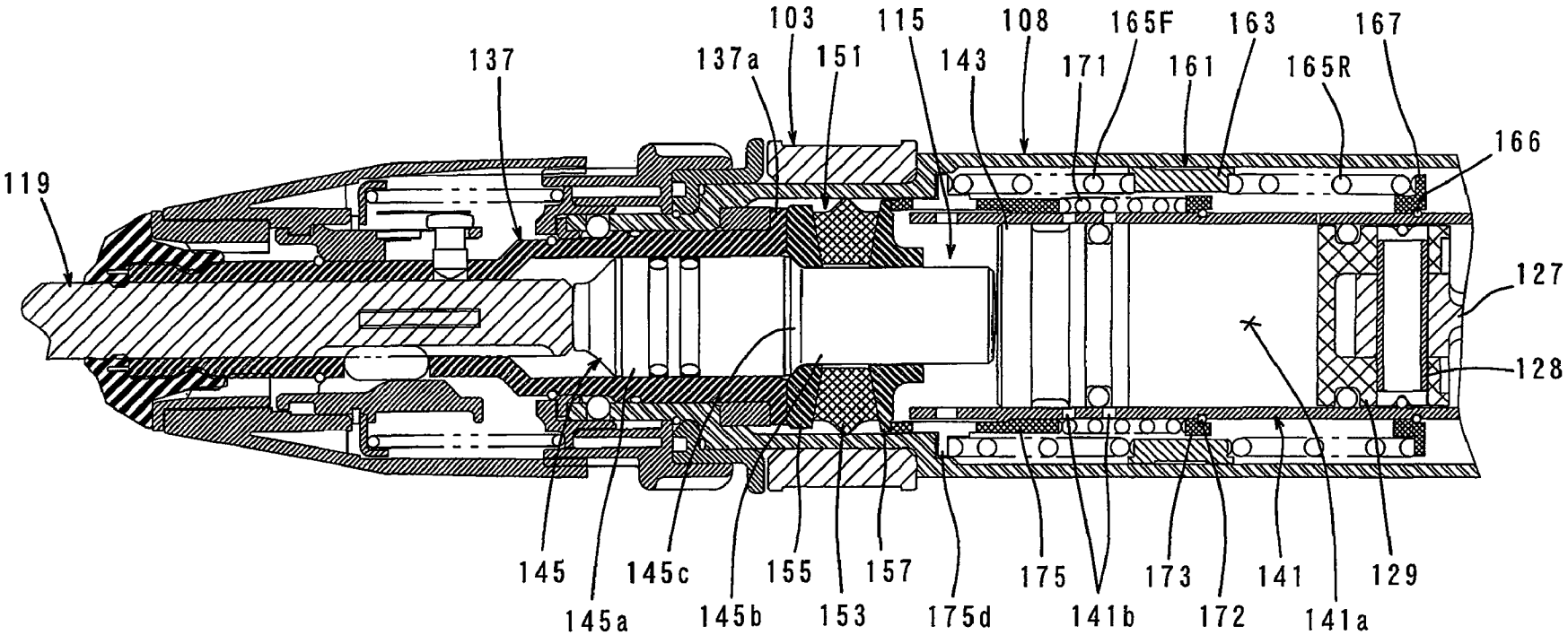
FIG. 11 is an enlarged sectional view showing the essential part of the electric hammer, under loaded conditions in which the hammer bit is pressed against a workpiece.
Figure 12:
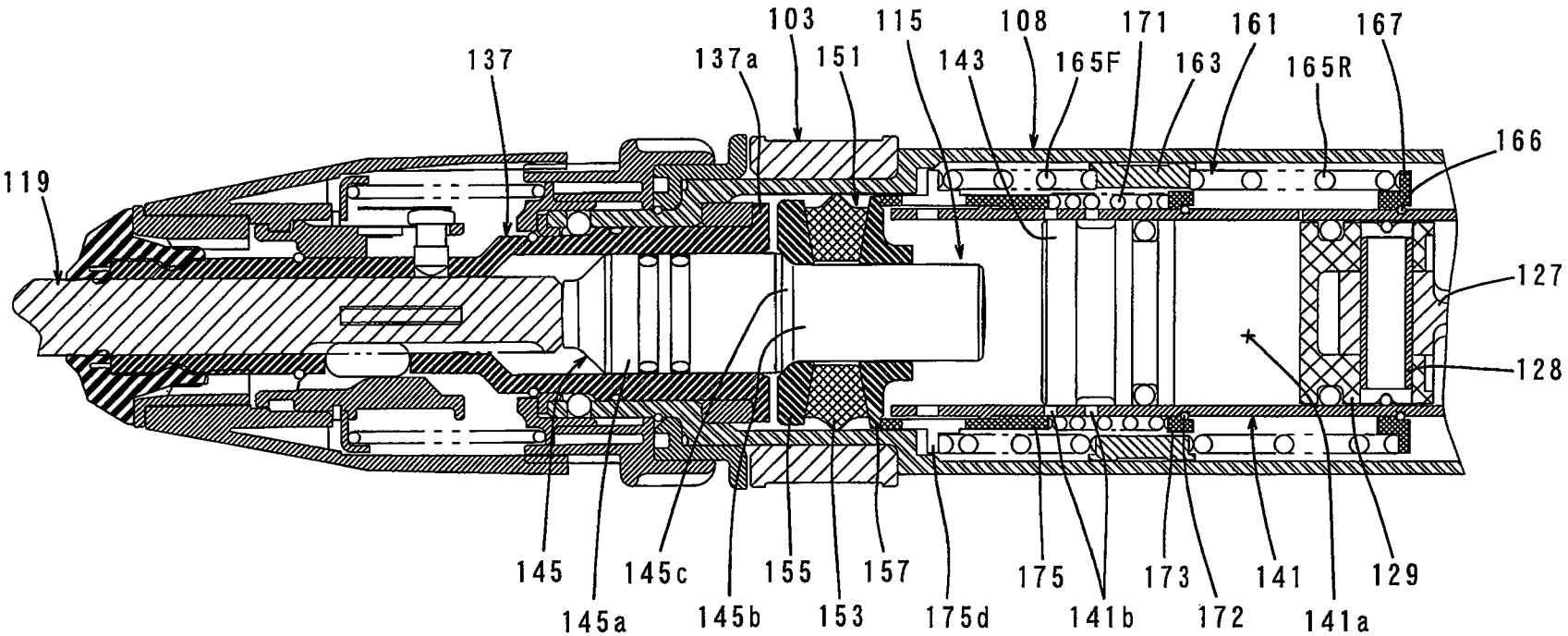
FIG. 12 is a sectional plan view of the hammer, in the state of absorbing a reaction force caused by rebound of the hammer bit.

A third embodiment of the present invention is now described with reference to FIGS. 10 to 12. FIG. 10 shows the unloaded state in which the hammer bit is not pressed against the workpiece, FIG. 11 shows the loaded state in which the hammer bit is pressed against the workpiece, and FIG. 12 shows the reaction force absorbing state. In this embodiment, the compression coil spring 171 and biasing springs 165F, 165R of a dynamic vibration reducer 161 are utilized to position the body 103 with respect to the workpiece in advance of a hammering operation and to absorb the reaction force that the hammer bit 119 receives from the workpiece after its striking movement. In the other points, it has the same construction as the first embodiment. Components or elements in this embodiment which are substantially identical to those in the first embodiment are given like numerals as in the first embodiment and will not be described.

Like in the first embodiment, the compression coil spring 171 is disposed outside the cylinder 141 and elastically placed between the front surface of the spring receiving ring 173 which is fastened to the cylinder 141 via the retaining ring 172 and the rear surface of the reaction force transmitting member in the form of the spring receiving member 175. The spring receiving member 175 is a cylindrical component disposed between the positioning member 151 and the compression coil spring 171. The spring receiving member 175 is fitted on the cylinder 141 such that it can slide in the axial direction of the hammer bit. The front end of the spring receiving member 175 is held in contact with the rear surface of the rear metal washer 157 of the positioning member 151. The positioning member 151 is held in contact with the rear end 137*a* of the tool holder 137.

The dynamic vibration reducer 161 is disposed within the internal space of the cylindrical member 108 and mainly includes a cylindrical weight 163 disposed outside the compression coil spring 171, and the front and rear biasing springs 165F, 165R disposed on the front and rear sides of the weight 163 in the axial direction of the hammer bit. The front and rear biasing springs 165F, 165R exert a spring force on the weight 163 in a direction toward each other when the weight 163 moves in the axial direction of the hammer bit 119.

The weight 163 is arranged such that its center coincides with the axis of the hammer bit 119 and can freely slide with its outside wall surface held in contact with the inside wall surface of the gear housing 107. Further, the front and rear biasing springs 165F, 165R are formed by compression coil springs and, like the weight 163, they are arranged such that each of their centers coincides with the axis of the hammer bit 119. One end (rear end) of the rear biasing spring 165R is held in contact with the front surface of a spring receiving ring 167 which is fastened to the cylinder 141 via a retaining ring 166, while the other end (front end) is held in contact with the axial rear end of the weight 163. Further, one end (rear end) of the front biasing spring 165F is held in contact with the axial front end of the weight 163, while the other end (front end) is held in contact with a flange 175*d* of the spring receiving member 175.

The dynamic vibration reducer 161 having the above-described construction serves to reduce impulsive and cyclic vibration caused during hammering operation (when the hammer bit 119 is driven). Specifically, the weight 163 and the biasing springs 165F, 165R serve as vibration reducing elements in the dynamic vibration reducer 161 and cooperate to passively reduce vibration of the body 103 of the hammer 101. Thus, the vibration of the hammer 101 can be effectively alleviated or reduced.

Further, in this embodiment, the cylinder 141 is normally pressed against the end surface 107*b* of the cylinder holding portion 107*a* by the biasing forces of the compression coil spring 171 and the biasing springs 165F, 165R which act in the rearward direction (see FIG. 5). Thus, the cylinder 141 can be prevented from becoming dislodged from the cylinder holding portion 107*a*. Therefore, like in the first embodiment, the need for a locking means for locking the cylinder 141 to the cylinder holding portion 107*a* is eliminated, so that the structure can be simplified. Further, due to elimination of the need for the locking means, the cylinder can be easily mounted or dismounted to or from the tool body.

Under loaded conditions in which the hammer bit 119 is pressed against the workpiece by the user, when the impact bolt 145 is retracted together with the hammer bit 119, the tapered portion 145*c* of the impact bolt 145 contacts the positioning member 151 in a predetermined retracted position. The rear metal washer 157 of the positioning member 151 is held in contact with the spring receiving member 175 which receives the biasing force of the compression coil spring 171. The compression coil spring 171 and the biasing springs 165F, 165R elastically receive the user's pressing force of pressing the hammer bit 119 against the workpiece, so that the body 103 is positioned with respect to the workpiece. Therefore, the compression coil spring 171 and the biasing springs 165F, 165R are configured to normally have excess pressure larger than a user's force of pressing the hammer bit 119 against the workpiece.

When the body 103 is positioned with respect to the workpiece, and in this state, a hammering operation is performed, the dynamic vibration reducer 161 serves as a vibration reducing mechanism in which the weight 163 and the biasing springs 165F, 165R cooperate to passively reduce cyclic vibration caused in the body 103 in the axial direction of the hammer bit. Thus, the vibration of the hammer 101 can be effectively alleviated or reduced.

After striking movement of the hammer bit 119 upon the workpiece, the hammer bit 119 is caused to rebound by the reaction force from the workpiece. A reaction force caused by this rebound moves the impact bolt 145, the positioning member 151 and the spring receiving member 175 rearward and elastically deforms the compression coil spring 171 and the biasing springs 165F, 165R of the dynamic vibration reducer 161. Specifically, the reaction force caused by rebound of the hammer bit 119 is absorbed by elastic deformation of the compression coil spring 171 and the biasing springs 165F, 165R, so that transmission of the reaction force to the body 103 is reduced. At this time, the rear metal washer 157 of the positioning member 151 faces the front end surface of the cylinder 141 with a predetermined clearance therebetween and can come into contact with it, so that the maximum retracted position of the positioning member 151 is defined. Therefore, the reaction force absorbing action of the compression coil spring 171 and the biasing springs 165F, 165R is effected within the range of the above-mentioned clearance.

Further, the reaction force of rebound of the hammer bit 119 is inputted to the weight 163 via the impact bolt 145, the positioning member 151, the spring receiving member 175 and the biasing springs 165F, 165R. Specifically, the reaction force of rebound of the hammer bit 119 serves as a vibration means for actively vibrating (driving) the weight 163 of the dynamic vibration reducer 161. Thus, the dynamic vibration reducer 161 serves as an active vibration reducing mechanism for reducing vibration by forced vibration in which the weight 163 is actively driven. Therefore, the vibration which is caused in the body 103 during hammering operation can be further effectively reduced or alleviated. As a result, a sufficient vibration reducing function can be ensured even in the operating conditions in which, although vibration reduction is highly required, only a small amount of vibration is inputted to the dynamic vibration reducer 161 and the dynamic vibration reducer 161 does not sufficiently function, particularly, for example, in an operation which is performed with the user's strong pressing force applied to the power tool.

Further, in this embodiment, the weight 163 and the biasing springs 165F, 165R which form the dynamic vibration reducer 161 are annularly arranged outside the cylinder 141. Thus, the outer peripheral space of the cylinder 141 can be effectively utilized. Further, it can be arranged such that the centers of gravity of the weight 163 and the biasing springs 165F, 165R are placed on the axis of the hammer bit 119. As a result, a couple (force of lateral rotation around an axis extending transverse to the longitudinal direction of the hammer bit) can be prevented from acting upon the body 103.

Further, according to this invention, the compression coil spring 171 and the dynamic vibration reducer 161 are disposed outside the cylinder 141. The rear ends of the compression coil spring 171 and the dynamic vibration reducer 161 are received by the spring receiving ring 173 which is prevented from moving rearward by the retaining ring 172 fastened to the cylinder 141, while the front ends are received by the spring receiving member 175 which is prevented from moving forward by the flange 141*c* of the cylinder 141. Thus, in the state in which the compression coil spring 171 and the dynamic vibration reducer 161 are mounted on the cylinder 141, the cylinder 141, the compression coil spring 171 and the dynamic vibration reducer 161 are integrated into one component. Therefore, the cylinder 141, the compression coil spring 171 and the dynamic vibration reducer 161 can be mounted or dismounted to or from the cylinder holding portion 107*a* of the gear housing 107 as one complete component. Thus, the ease of mounting or repair can be increased.

Further, in the above-described embodiment, the electric hammer 101 was described as a representative example of the impact tool. However, naturally, the present invention can also be applied to a hammer drill in which the hammer bit 119 can perform a striking movement in its axial direction and a rotation around its axis.

Further, in the above embodiment, the crank mechanism was described as being used as the motion converting mechanism 113 for converting the rotating output of the driving motor 111 to linear motion in order to linearly drive the hammer bit 119. However, the motion converting mechanism is not limited to the crank mechanism, but, for example, a swash plate that axially swings may be utilized as the motion converting mechanism.

As an aspect of the above-described invention, following features may be provided.

The impact tool further comprising a positioning member that is disposed between the hammer actuating member and the compression coil spring, the positioning member being held in contact with the hammer actuating member under loaded conditions in which the hammer actuating member is pressed against the workpiece and pushed to the side of the driving element, while being separated from the hammer actuating member under unloaded conditions in which the hammer actuating member is not pressed against the workpiece, wherein a reaction force which is caused by rebound from the workpiece and acts upon the hammer actuating member is transmitted to the compression coil spring via the positioning member. According to this aspect of the invention, the reaction force that the hammer actuating member receives from the workpiece can be absorbed by elastic deformation of the compression coil spring which is caused by rearward movement of the positioning member. As a result, vibration of the impact tool can be lowered.

DESCRIPTION OF NUMERALS

101 electric hammer (impact tool)
103 body (tool body)
105 motor housing
107 gear housing
107*a* cylinder holding portion
107*b* end surface
108 cylindrical member
108*a* stepped surface
109 handgrip
109*a* slide switch
111 driving motor
113 motion converting mechanism
115 striking mechanism
119 hammer bit (hammer actuating member)
121 driving gear
123 driven gear
125 crank plate
126 eccentric shaft
127 crank arm
128 connecting shaft
129 piston (driving element)
137 tool holder
137*a* rear end
141 cylinder
141*a* air chamber
141*b* air vent
141*c* flange (stopper)
143 striker (striking element)
145 impact bolt (intermediate element, hammer actuating member)
145*a* large-diameter portion
145*b* small-diameter portion
145*c* tapered portion
151 positioning member
153 rubber ring
155 front metal washer
157 rear metal washer
161 dynamic vibration reducer
163 weight
165F, 165R biasing spring
166 retaining ring
167 spring receiving ring
171 compression coil spring
172 retaining ring
173 spring receiving ring
175 spring receiving member
175*a* large inside-diameter portion
175*b* small inside-diameter portion
175*c* engagement surface
175*d* flange
181 slide sleeve
181*a* rear end
183 pressure spring

I claim:

1. An impact tool comprising:

a tool body;

a hammer actuating member which performs a predetermined hammering operation on a workpiece by a striking movement in an axial direction, the workpiece being located at a front side of the impact tool, and the axial direction extending between the front side of the impact tool and a rear side of the impact tool;

a cylinder that drives the hammer actuating member, the cylinder being housed within the tool body; and a compression coil spring that contacts the hammer actuating member and thereby positions the tool body with respect to the workpiece when the hammer actuating member is pressed against the workpiece and pushed rearward in advance of the hammering operation, and in this position, absorbs a reaction force that is caused by rebound from the workpiece and acts upon the hammer actuating member when the hammer actuating member performs the hammering operation on the workpiece, wherein:

the cylinder is disposed within a housing part of the tool body along the axial direction and a rear part of the cylinder directly contacts an abutment of the housing part of the tool body; and the compression coil spring applies a biasing force to the cylinder in a rearward direction and thereby holds the cylinder against the housing part abutment, thereby axially fixing the cylinder relative to the housing part.

2. The impact tool as defined in claim 1, wherein the compression coil spring is disposed outside the cylinder, and an axial rear end of the compression coil spring is locked while being prevented from moving rearward with respect to the cylinder, and an axial front end of the compression coil spring is locked while being allowed to move rearward and prevented from moving frontward with respect to the cylinder.

3. The impact tool as defined in claim 1, further comprising:

a driving element that linearly moves in the axial direction of the hammer actuating member within the cylinder, a striking element that linearly moves in the axial direction of the hammer actuating member within the cylinder, an air chamber defined between the driving element and the striking element within the cylinder, wherein the striking element is caused to linearly move via pressure fluctuations of the air chamber as a result of the linear movement of the driving element and strikes the hammer actuating member, whereby the predetermined hammering operation is performed on the workpiece, a communication part that is formed in the cylinder and provides communication between the air chamber and the outside in order to prevent idle driving, and a movable member that is disposed outside the cylinder and movable between an open position for opening the communication part and a closed position for closing the communication part, wherein the movable member serves as a reaction force transmitting member for transmitting the reaction force of rebound which acts upon the hammer actuating member, to the compression coil spring.

4. The impact tool as defined in claim 3, wherein the movable member is defined by a cylindrical member slidably fitted onto the cylinder.

5. The impact tool as defined in claim 1, further comprising a positioning member that is disposed between the hammer actuating member and the compression coil spring, the positioning member being held in contact with the hammer actuating member under loaded conditions in which the hammer actuating member is pressed against the workpiece and pushed to the side of the driving element, while being separated from the hammer actuating member under unloaded conditions in which the hammer actuating member is not pressed against the workpiece, wherein a reaction force which is caused by rebound from the workpiece and acts upon the hammer actuating member is transmitted to the compression coil spring via the positioning member.

6. The impact tool as defined in claim 1 further comprising a dynamic vibration reducer having a weight that is elastically biased by a biasing force, wherein the compression coil spring also serves a biasing spring to provide biasing force to the weight of the dynamic vibration reducer.

* * * * *